US005440984A

United States Patent [19]

Becker

[11] Patent Number: 5,440,984

[45] Date of Patent: Aug. 15, 1995

[54] DEVICE FOR CLAMPING FLEXIBLE PRINTING PLATES ON THE PLATE CYLINDER OF ROTARY PRINTING PRESSES

[75] Inventor: Willi Becker, Bammental, Germany

[73] Assignee: Heidelberger Druckmaschinen Aktiengesellschaft, Heidelberg, Germany

[21] Appl. No.: 194,247

[22] Filed: Feb. 10, 1994

[30] Foreign Application Priority Data

Feb. 13, 1993 [DE] Germany ..... 43 04 328.3

[51] Int. Cl.[6] ..... B41F 27/06; B41F 27/12

[52] U.S. Cl. ..... 101/415.1; 101/382.1; 101/DIG. 36; 101/388

[58] Field of Search ..... 101/382.1, 387, 388, 101/415.1, DIG. 36

[56] References Cited

U.S. PATENT DOCUMENTS

| | | | |
|---|---|---|---|
| 4,862,800 | 9/1989 | Wieland et al. | 101/415.1 |
| 5,097,763 | 3/1992 | Simeth | 101/382.1 |
| 5,189,958 | 3/1993 | Tafel et al. | 101/415.1 |
| 5,322,014 | 6/1994 | Keller | 101/415.1 |

FOREIGN PATENT DOCUMENTS

| | | |
|---|---|---|
| 1536954 | 2/1970 | Germany . |
| 3936446 | 5/1991 | Germany . |
| 4134365 | 4/1993 | Germany . |

*Primary Examiner*—Edgar S. Burr
*Assistant Examiner*—Lynn D. Hendrickson
*Attorney, Agent, or Firm*—Nils H. Ljungman & Associates

[57] ABSTRACT

A device for clamping flexible printing plates on the plate cylinder of rotary printing presses can have tensioning bars provided in a recess of the plate cylinder, to which tensioning bars the ends of the printing plates can be fastened, and can also be provided with an apparatus for correcting the diagonal register of the plate cylinder by providing swivelling of the tensioning bars. The adjustment apparatus can be configured with relatively few joints and the adjustment can be done with as little play as possible and with only minimal influencing of the set values for the circumferential and lateral registers. The arrangement provides a configuration wherein at least one of the tensioning bars can be axially displaced during the swivelling of the tensioning bars in a circumferential direction within the plate cylinder.

20 Claims, 3 Drawing Sheets

DEVICE FOR CLAMPING FLEXIBLE PRINTING PLATES ON THE PLATE CYLINDER OF ROTARY PRINTING PRESSES

BACKGROUND OF THE INVENTION

1. Field of the Invention

The invention relates to a device for clamping flexible printing plates on the plate cylinder of rotary printing presses. Such a device can often be equipped with an apparatus for correcting the diagonal register of the printing plate by permitting a swivelling of the tensioning bars, wherein the ends of the plate can be clamped in the tensioning bars. Such correction apparatus can typically be provided in a recess of the plate cylinder.

2. Background Information

A known design of the type described above is provided in German Patent No. 15 36 954 C1. In this known device, both tensioning bars for the front and rear edges of the printing plate are adjustably held in slots by guide bolts. A lever which is swivellable about a pivot point and which, at its ends, engages both of the tensioning bars is provided for carrying out the adjustment. Through the intermediary of a work wheel and a worm wheel, the lever can be swivelled about a pivot point. As a result of the swivelling of the lever, the tensioning bars are moved in opposite directions and execute a swivelling motion through the intermediary of the slots and the guide bolts. The disadvantage of such a design is in the fact that there is a multiplicity of joints, with play-free motion not being possible in the long run, particularly in the slots for guiding the two tensioning bars.

Furthermore, with this known design, there is virtually no possibility, in the region of the printing plate, of a measuring point from which to determine the register error. That is, in the case of an adjustment to the diagonal register, it is also necessary to reset the circumferential and lateral registers, with this normally being checked by means of specimen prints. The known design, therefore, involves a complicated and time-consuming setting of the precise register.

OBJECT OF THE INVENTION

In view of the disadvantages of this known design, the object of the present invention is to create a device for setting the diagonal register, the device having only a few joints and allowing the setting to be performed with as little play as possible. It is also desirable that the device have a minimum influence on the circumferential and lateral registers when an adjustment is made to the diagonal register.

SUMMARY OF THE INVENTION

The object of the invention is achieved in a device wherein the tensioning bar for the front edge of the printing plate is held in the region of a plate side edge in such a manner as to be swivellable about a bolt attached in the recess of the plate cylinder. Further, on the opposite side away from the bolt, an eccentric bolt can be rotatably mounted in the tensioning bar. This eccentric bolt preferably has an eccentric pin which can be guided in an oblong hole in the base of the recess. In addition, the tensioning bar for the rear edge of the printing plate can preferably be axially displaceably mounted on the tensioning bar for the front edge, and an angle lever can be swivellably mounted on the tensioning bar for the front edge. One lever arm of the angle lever can embrace, in the region of the eccentric bolt, a pin attached in the recess of the plate cylinder, and the other lever arm of the angle lever can preferably engage, with a roller, a slot on the tensioning bar for the rear edge. Thus, when the tensioning bar for the front edge is swivelled in the circumferential direction of the plate cylinder, the tensioning bar for the rear edge can be swivelled and axially displaced.

This design according to the present invention provides an essentially play-free and stable holding of all of the components involved in the adjustment. Thus, essentially, in order to adjust the printing plate, one generally needs to merely loosen the printing plate on the plate cylinder, for example by means of a quick-action lock. Furthermore, the position of the swivel point for the tensioning bar for clamping the front edge of the printing plate permits, in the region of the front and side edges of the printing plate itself, the precise measurement of the required lateral- and circumferential-register errors when the differences are measured in the region of the swivel point. In the case of an adjustment to the diagonal register, therefore, the circumferential and lateral registers can essentially remain unaffected, with the result that resetting will generally not be required, as the tensioning bars essentially remain parallel to each other in every situation.

A low-cost and simple design variant for achieving the object of the invention can be realized by a device wherein the tensioning bar for the front edge of the printing plate is held in the region of a plate side edge in such a manner as to be swivellable about a bolt attached in the recess of the plate cylinder. Further, on the opposite side away from the bolt, an eccentric bolt can preferably be rotatably mounted in the tensioning bar. An eccentric pin of this eccentric bolt can preferably be guided in an oblong hole in the base of the recess. In addition, the tensioning bar for the rear edge of the printing plate can be axially displaceably mounted on the tensioning bar for the front edge. Thus, for the axial displacement of the tensioning bar for the rear edge of the printing plate, a plunger can preferably penetrate, in the region of the eccentric bolt, the tensioning bar for the front edge. This plunger can preferably be supported under the force of a spring on a side wall of the recess adjacent the front edge, and can have, at its opposite end a bevelled section, which bevelled section can be configured to engage a bevelled cut-out in the tensioning bar for the rear edge. Thus, when the tensioning bar for the front edge is swivelled, the tensioning bar for the rear edge can be swivelled and axially displaced.

In an advantageous embodiment of the present invention, the eccentric bolt for diagonal positioning of the printing plate can be provided on the operating side of the printing press and the tensioning bar for the front edge can be swivellably pressed onto the base of the recess by means of through-bolts with cup springs. Furthermore, the tensioning bar for the rear edge can be configured with a compression spring to essentially makes it possible to eliminate any bearing play occurring in the angle lever or in the plunger.

In summary, one feature of the invention resides broadly in a device for clamping a flexible printing plate on a plate cylinder of a rotary printing press and for correcting diagonal register of the printing plate on the plate cylinder. The printing plate having first and second ends, the plate cylinder having a recess therein for accomodating the device, and the recess having a base with first and second side portions disposed in a spaced apart relationship with one another. The device comprises: a first clamp device for being disposed within the recess to clamp the first end of the printing plate to the plate cylinder, the first clamp device having a first end and a second end; a second clamp device for being disposed within the recess to clamp the second end of the printing plate to the plate cylinder; apparatus for mounting the first clamp device in the recess of the plate cylinder, the apparatus for mounting comprising a pivot disposed adjacent the first end of the first clamp device, the second end of the first clamp device being pivotable about the pivot; apparatus for pivoting the second end of the first clamp device with respect to the pivot, and the apparatus for pivoting comprising a bolt element defining a longitudinal axis and being disposed radially through the first clamp device. The bolt element having a first end for being disposed in a slot within the recess, and the first end comprising a pin element, the pin element defining a longitudinal axis, with the longitudinal axis of the pin element being parallel to and eccentric with respect to the longitudinal axis of the bolt element; and the bolt element being configured to rotate within the first clamp device eccentrically about the pin element to pivot the first clamp device within the recess of the plate cylinder. The device also comprises apparatus for connecting the second clamp device to the first clamp device, with the second clamp device being axially displaceable within the apparatus for connecting; and a lever element configured for axially displacing the second clamp device during pivoting of the first clamp device. The lever element comprising: a pivot fixedly mounted on the first clamp device adjacent the second clamp device; a first lever arm having a first end at said pivot and extending in a direction towards the second end of the first clamp device to a second end; a second lever arm having a first end at the pivot and extending to a second end at the second clamp device; wherein the second clamp device comprises apparatus for engaging the second end of the second lever arm therein, while the plate cylinder has, within the recess thereof, apparatus for engaging the second end of the first lever arm. The second end of the second lever arm is configured to move axially towards and away from the first end of the first clamp device during pivoting of the first clamp device towards and away from the first side of the recess of the plate cylinder to axially displace the second clamp device.

Another aspect of the invention resides broadly in a device for clamping a flexible printing plate on a plate cylinder of a rotary printing press and for correcting diagonal register of the printing plate on the plate cylinder. The printing plate having first and second ends, the plate cylinder having a recess therein for accomodating the device, and the recess having a base with first and second side portions disposed in a spaced apart relationship with one another. The device comprises: a first clamp device for being disposed within the recess to clamp the first end of the printing plate to the plate cylinder, the first clamp device having a first end and a second end; a second clamp device for being disposed within the recess to clamp the second end of the printing plate to the plate cylinder; apparatus for mounting the first clamp device in the recess of the plate cylinder, the apparatus for mounting comprising a pivot disposed adjacent the first end of the first clamp device, the second end of the first clamp device being pivotable about the pivot; apparatus for pivoting the second end of the first clamp device with respect to the pivot, and the apparatus for pivoting comprising a bolt element defining a longitudinal axis and being disposed radially through the first clamp device. The bolt element having a first end for being disposed in a slot within the recess, and the first end comprising a pin element, the pin element defining a longitudinal axis, with the longitudinal axis of the pin element being parallel to and eccentric with respect to the longitudinal axis of the bolt element; and the bolt element being configured to rotate within the first clamp device eccentrically about the pin element to pivot the first clamp device within the recess of the plate cylinder. The device also comprises apparatus for connecting the second clamp device to the first clamp device, with the second clamp device being axially displaceable within the apparatus for connecting. The first clamp device has a bore therein from a first side thereof to a second side thereof, with the bore being disposed adjacent the second end of the first clamp device. The first clamp device further comprises a rod element disposed within the bore of the first clamp device, with the rod element having: a first end biased in a direction away from the first clamp device and configured to engage the first side of the recess of the plate cylinder to maintain the rod element in a fixed circumferential position within the recess; and a second end disposed in engagement with the second clamp device; wherein the second clamp device comprises a recess therein for receiving the second end of the rod element therein; and the second end of the rod element comprising a bevelled surface configured for engaging a surface of the recess of the second clamp device for axially displacing said second clamp device in an axial direction of the plate cylinder upon the first clamp device and second clamp device being pivoted within the recess.

Still another feature of the invention resides broadly in a device for clamping a flexible printing plate on a plate cylinder and for correcting diagonal register of the printing plate, the printing plate having first and second ends, the plate cylinder having a recess therein for receiving the device, and the recess having a base with first and second side portions disposed in a spaced apart relationship with one another. The device comprises a first clamp element for being disposed within the recess to clamp the first end of the printing plate to the plate cylinder; a second clamp element for being disposed within the recess to clamp the second end of the printing plate to the plate cylinder; with the first and second clamp elements each defining a longitudinal dimension, and the longitudinal dimension of each of the first and second clamp elements for being disposed substantially along an axial direction of the plate cylinder. The device also comprises apparatus for connecting the first and second clamp elements to form a clamping unit; apparatus for mounting the clamping unit in the recess of the plate cylinder; apparatus for pivoting, at least in a substantially circumferential direction of the plate cylinder, at least a substantial portion of the clamping unit as an integral unit about a sole pivot within the recess; apparatus for determining the pivoting of the clamping unit; and apparatus for simultaneously axially displacing, during the pivoting of the substantial portion of the clamping unit, at least one of the first and second clamp elements an axial distance corresponding to the pivoting of the substantial portion of the clamping unit.

BRIEF DESCRIPTION OF THE DRAWINGS

Specimen embodiments of the present invention are schematically represented in the following drawings, in which.

DESCRIPTION OF THE PREFERRED EMBODIMENTS

Figure 6:
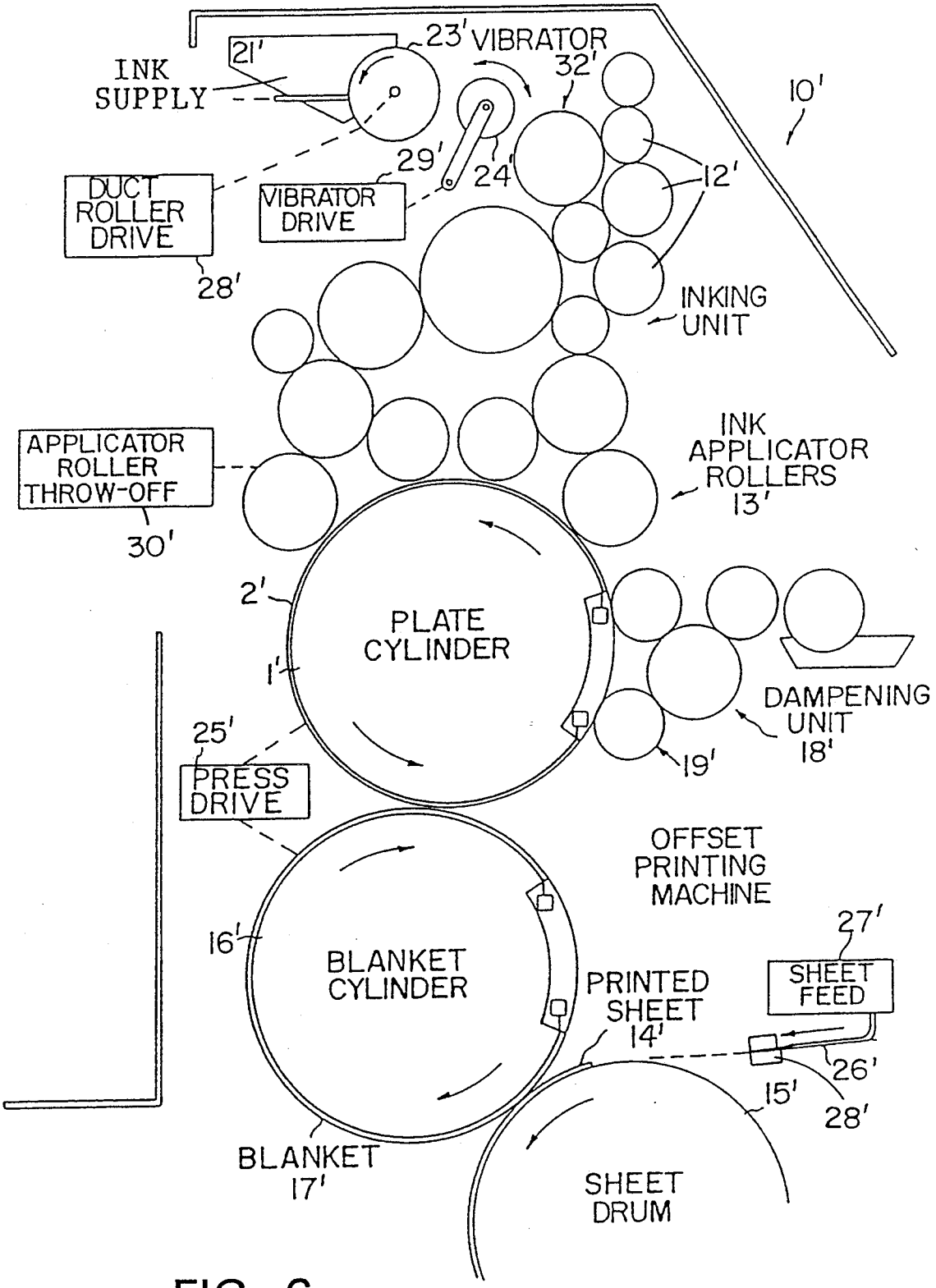
FIG. 6 shows a general configuration of a printing press.

In general, as shown in FIG. 6, which representation could be considered to show an access side of a printing press, a printing press can have a print stand 10' which can provide a supporting framework for the internal components thereof. Such components of a printing press, depending on the type of printing press, can include a plate cylinder 1' for having mounted thereon a printing plate 2', and an inking unit for transferring ink to the plate cylinder 1'. The inking unit can essentially be considered to include an ink fountain 21', a duct roller 23' for receiving ink from the ink fountain 21', a vibrator roller 24' which oscillates to successively pick up ink from the duct roller 23' and deposit the same on a roller 32', and a plurality of ink transfer rollers 12' for transferring the ink from the roller 32' to the ink applicator rollers 13'.

In addition, a printing press can also generally include a damping (or wetting) unit 18' having dampening applicator rollers 19' for transferring a damping agent to the printing plate 2'.

Once the printing plate 2' has been inked, the ink impression of the printing plate can preferable be applied to a rubber blanket 17' on a blanket cylinder 16'. The blanket cylinder 16' can then transfer the image to a sheet of printing stock 26' to produce a printed sheet 14'. A sheet drum 15' can supply the sheets of printing stock from a sheet feed device 27'.

In order to insure that the printed images from the printing plate 2' are properly positioned on the sheets of printing stock 26', the plate cylinder can be configured with various devices for adjusting the various registers of the printing plate 2', which various registers can include the circumferential register, the lateral register, and the diagonal register. The present invention provides one type of device for adjusting the diagonal register, while minimally influencing the circumferential register and lateral register, after such registers have already been set.

Figure 1:
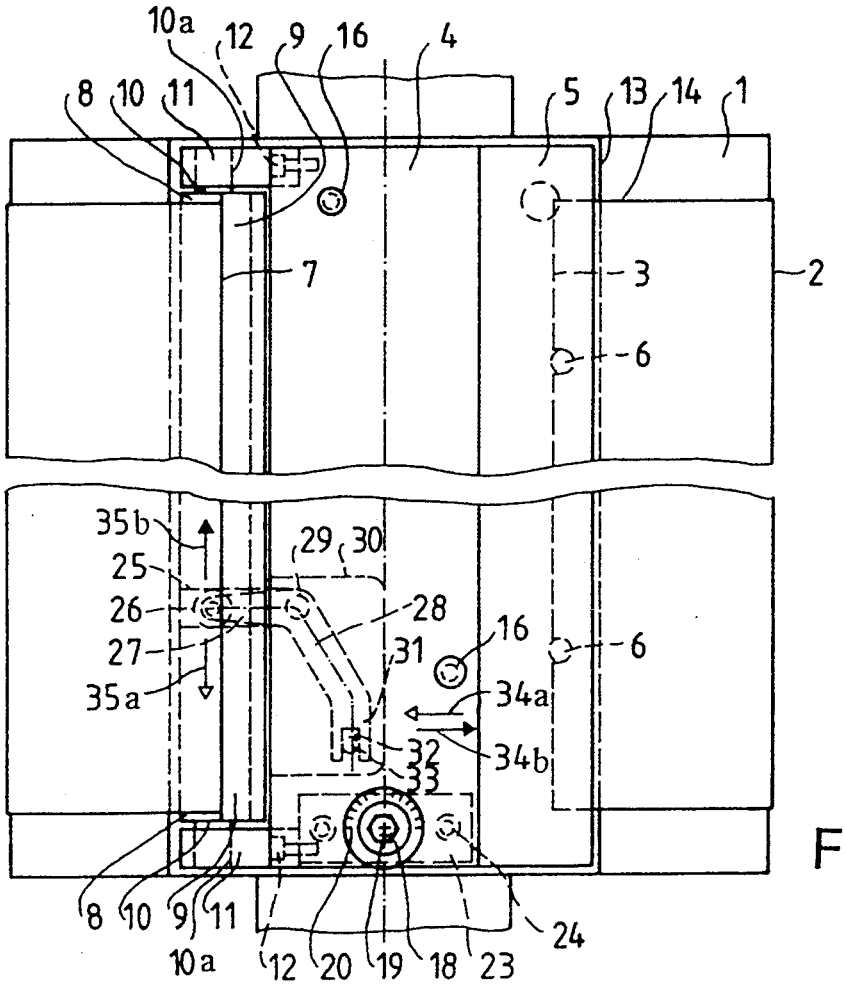
FIG. 1 shows a top view of the plate cylinder with tensioning bars for a printing plate.

As illustrated in FIG. 1, the plate cylinder 1 can preferably have a flexible printing plate 2 clamped thereon. The plate cylinder can preferably have a recess 13 in which a clamping apparatus can be located. A front edge 3 of the printing plate 2 can preferably be clamped between a tensioning bar 4 and a clamping bar 5 adjacent a first edge of the recess 13. Fitted bolts 6 can preferably be used for the in-register clamping of the printing plate 2. In general, clamping arrangements are well known in the field, and are not discussed in any great detail herein.

The rear edge 7 of the printing plate 2 can, likewise, preferably be clamped between a tensioning bar 8 and a clamping bar 9 disposed adjacent a second edge of the recess 13. The tensioning bar 8 and also the clamping bar 9 can preferably be mounted onto the tensioning bar 4 by means of pedestal bearings 11.

Figure 2:
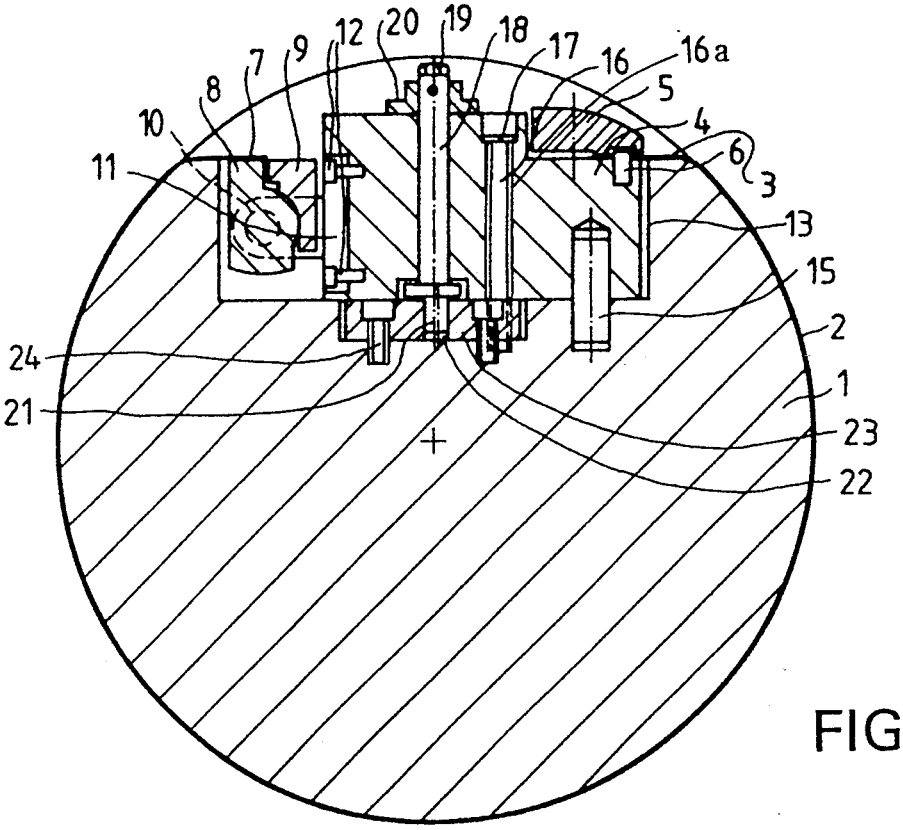
FIG. 2 shows a cross section through both the plate cylinder and the locking means for the printing plate.

The pedestal bearings 11 can preferably be attached to the tensioning bar 4 by means of screws 12 (FIGS. 1 and 2). Such pedestal bearings 11 can preferably allow the tensioning bar 8 and clamping bar 9 to be longitudinally displaceable through the intermediary of pins 10 on the tensioning bar 8. That is, the tensioning bar 8 can preferably have pins 10 extending from both ends thereof, which pins 10 are received by recesses **10*a* in the pedestal bearings 11. The pins 10 are preferably slidably engaged in recesses 10*a*, while the tensioning bar 8 preferably has a length which is slightly less than the distance between the two bearings 11 to thereby allow for longitudinal movement of the tensioning bar 8 between the two bearing 11. In the specimen embodiment shown, the tensioning bars 4 and 8 and all the means cooperating therewith are attached in the recess 13 of the plate cylinder 1**.

In accordance with the present invention, the tensioning bar 4 for the front edge 3 of the printing plate 2 can preferably be held in the region of a plate side edge 14 in such a manner as to be swivellable about a bolt 15 attached in the recess 13 of the plate cylinder 1. To allow the tensioning bar 4 to execute swivelling motions about the bolt 15 on the base of the recess 13, the tensioning bar 4 can preferably be swivellably pressed into engagement with the base of the recess 13 by means of through-bolts 16 and cup springs 17.

In other words, the bolts 16 can pass somewhat loosely through slots **16*a* in the tensioning bar 4 and can be threaded into the base of the recess 13. By means of spring elements 17, disposed between the head of the bolts 16 and the tensioning bar 4, the tensioning bar can be resiliently pressed towards the base of the recess 13. The slots 16a, through which the bolts 16, pass can preferably have at least a slightly larger diameter than a diameter of the bolts 16, thereby allowing for movement of the tensioning bar 4 relative to the bolts 16**.

On the side of the tensioning bar 4 opposite the bolt 15, a bolt 18 can preferably be rotatably mounted in the tensioning bar 4. This bolt 18 can be configured with a hexagonal section 19 to allow for turning of the bolt 18, and can also be configured to have a scale ring 20 disposed thereabout to allow for setting of the position of the tensioning bar 4. The bolt 18 can generally define a first longitudinal axis therethrough. An eccentric pin 21 can preferably be provided on the side of the bolt 18 opposite the hexagonal section 19. This eccentric pin 21 can preferably define a second longitudinal axis parallel to but eccentric with the longitudinal axis of the bolt 18, and this pin 21 can preferably be guided in an oblong hole 22 in the base of the recess 13. To allow precise setting, the oblong hole 22 can preferably be, as shown in the specimen embodiment shown in FIGS. 1 and 2, provided in a base plate 23, which base plate 23 can preferably be attached in the base of the recess 13 by means of screws 24.

The eccentric bolt 18, because of its mounting via the eccentric pin 21, can thereby act as a cam for moving the tensioning bar 4. Since the pin 21 is offset eccentrically from the bolt 18, a turning of the bolt 18 will cause the bolt 18 to rotate along an arcuate path about the pin 21, thereby swivelling the tensioning bar 4 during the rotation of the bolt 18.

Upon swivelling the tensioning bar 4 to adjust the diagonal register, because the tensioning bar 8 is attached to the tensioning bar 4 by means of bearings 11, the tensioning bar 8 will also preferably be swivelled. In order to minimize changing of the circumferential and alteral registers, the present invention provides an angled lever arm 28 interconnecting the tensioning bar 4 and the tensioning bar 8 to offset the tensioning bar 8 in a direction along a longitudianl axis thereof, upon a swivelling of the tensioning bar 4.

Figure 3:
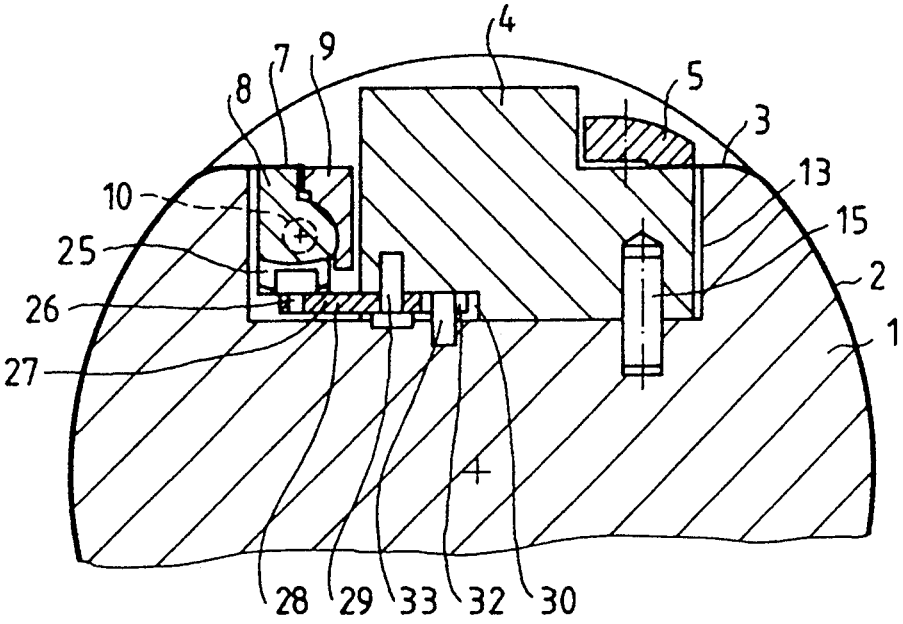
FIG. 3 shows a cross section through the plate cylinder with an angle lever for guiding the rear tensioning bar.

The tensioning bar 8 for the rear edge 7 of the printing plate 2 can preferably be provided on its underside with a slot 25 in which can be guided a first end of a lever arm 27 of the angle lever 28. One type of guide device which could be used on the first end of the lever arm 27 would be a roller 26 as shown in FIGS. 1 and 3. Alternatively, a simple pin could possibly also be used along with other conceivable guide elements which are commonly used in the field. The angle lever 28 can preferably be swivellably held on the tensioning bar 4 through the intermediary of a swivel pin 29. To accommodate the angle lever 28, the tensioning bar 4 can preferably be configured to have a cut-out, or cut-away section 30 disposed on an underside thereof, The angle lever 28 may advantageously be held and attached in the cut-out section 30 by means of the pin 29.

The angle lever 28 can also preferably have a second lever arm 31, with a fork-shaped opening 32 disposed at an end thereof. This fork-shaped opening 32 can preferably embrace a pin 33 provided in the vicinity of the eccentric bolt 18 and being attached in the base of the recess 13. Thus, when the tensioning bar 4 is swivelled to left or right in the direction of arrows 34*a* and 34*b* as shown in FIG. 1, the tensioning bar 8 and the angle lever 28, held in the tensioning bar 4 through the intermediary of the swivel pin 29, are likewise swivelled. In the process, the pin 33, fixedly disposed in the base of the recess 13, causes the angle lever 28 to rotate about the swivel pin 29, with the result that, through the intermediary of the slot 25, the roller 26 transmits the swivelling motion of the angle lever 28 to the tensioning bar 8, with the tensioning bar 8 being moved axially in the direction of arrows 35*a* and 35*b*, depending on the swivelling direction of the tensioning bar 4. In essence, the tensioning bar 8 will move in the direction of arrow 35*a* upon a swivelling of the tension bar 4 in the direction of arrow 34*a*, and likewise, tensioning bar 8 will move in the direction of arrow 35*b* upon movement of the tensioning bar 4 in the direction of arrow 34*b*.

The lengths of the lever arms 27 and 31 can preferably be configured such that the axial movement of the tensioning bar 8 will preferably be precisely equivalent to the amount by which the trailing rear edge 7 of the printing plate 2 is displaced on the axial direction of the plate cylinder 1 when the tensioning bar 4 and thus the front edge 3 of the printing plate 2 are diagonally positioned. The tensioning bars 4 and 8 are also preferably configured relative to one another so that the bars 4 and 8 preferably run parallel during any swivelling, with the result that, during the swivelling operation, essentially, one need merely slightly loosen the clamping of the printing plate 2. The clamping devices for the printing plate 2 are known and are not shown further in the drawings. In order to allow such adjustments to made as easily as possible, it is preferable that the eccentric bolt 18 for the diagonal positioning of the printing plate 2 be provided on the operating side of the printing press, and therefore within easy access to an operator.

Figure 4:
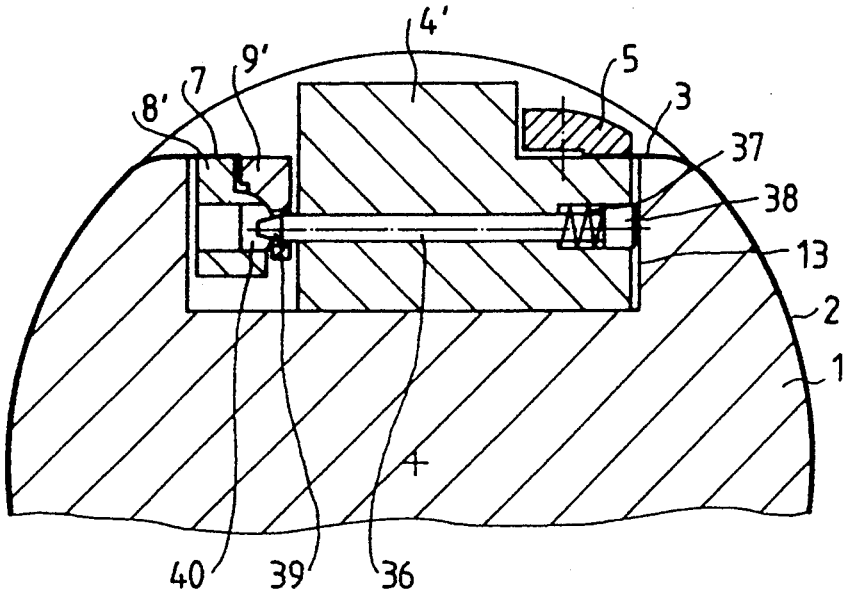
FIG. 4 shows a cross section through the plate cylinder with a plunger for guiding the rear tensioning bar.
Figure 5:
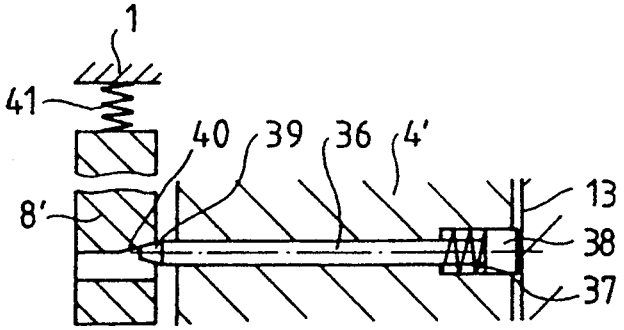
FIG. 5 shows a partial longitudinal section through the tensioning bars and plunger.

An alternative modification of the design according to the present invention as shown in FIGS. 1 to 3 is represented in FIGS. 4 and 5. In this embodiment, instead of the angle lever 28 with the associated adjusting means, a plunger 36 can preferably be provided to be axially displaceably held in the tensioning bar 4' opposite the bolt 15. The plunger 36 can preferably be provided in the region of the eccentric bolt 18 and can preferably penetrate the tensioning bar 8 transversely to the cylinder axis. Under the force of a resilient member, such as spring 37, a first end of the plunger 36 can be supported on, or maintained against the wall of the recess 13. This first end can preferably be fitted with an end-piece 38 for receiving the force of the spring 37.

The opposite end of the plunger 36 can preferably be configured to have a bevelled section 39 for engaging a bevelled cut-out 40 in the tensioning bar 8'. Thus, during setting of the register, when the tensioning bar 4', and thus also the tensioning bar 8' connected to bar 4', are swivelled about the bolt 15, the cut-out 40 can be moved to the left or right in the FIGS. 4 and 5, relative to the substantially stationary plunger 36. This movement of the cut-out 40 thereby essentially causes the cut-out 40 to also move substantially perpendicularly, or in essence, towards or away from the bevelled section 39, depending on the swivelling direction. The tensioning bar 8' can thereby undergo a movement according to the direction of the arrows 35*a* and 35*b*, corresponding to a movement of tensioning bar 4' in the direction of arrows 34*a* and 34*b*, respectively. This achieves the same effect obtained similarly with the aforedescribed angle lever.

For all of the embodiments described above, the tensioning bars 8 and 8' could be provided with a compression spring 41 to provide a play-free adjustment of the tensioning bar 8 or 8' with the aforedescribed adjusting means as shown in FIG. 5. This compression spring 41 can preferably act in the axial direction of the plate cylinder 1 to maintain a play-free engagement between the tensioning bar 8 or 8' and the roller 26 of angle lever 28 or bevelled section 39 of plunger 36. This compression spring 41 can preferably be supported on the plate cylinder 1.

It would also be possible that a clamping unit could be configured such that either, or both of the tensioning bars 4 and 8 could be displaced axially during a pivoting movement if such was desired, as the embodiments described above could essentailly be duplicated, or reversed for providing such an axial displacement of both of the tensioning bars 4 and 8.

One feature of the invention resides broadly in the device for clamping flexible printing plates on the plate cylinder of rotary printing presses with an apparatus for correcting the diagonal register by swivelling the tensioning bars provided in a recess of the plate cylinder, the ends of the plate being clamped in said tensioning bars, characterized in that the tensioning bar 4 for the front edge 3 of the printing plate 2 is held in the region of a plate side edge 14 in such a manner as to be swivellable about a bolt 15 attached in the recess 13 of the plate cylinder 1, in that, on the opposite side, an eccentric bolt 18 is rotatably held in the tensioning bar 4, the eccentric pin 21 of said eccentric bolt 18 being guided in an oblong hole 22 in the base of the recess 13, in that the tensioning bar 8 for the rear edge 7 of the printing plate 2 is axially displaceably held on the tensioning bar 4 for the front edge 3 and in that an angle lever 28 is swivellably held on the tensioning bar 4 for the front edge 3, one lever arm 31 of said angle lever 28 embracing, in the region of the eccentric bolt 18, a pin 33 attached in the recess 13 and the other lever arm 27 of said angle lever 28 engaging, with a roller 26, a slot 25 on the tensioning bar 8 for the rear edge 7, with the result that, when the tensioning bar 4 for the front edge 3 is swivelled in the circumferential direction of the plate cylinder 1, the tensioning bar 8 for the rear edge 7 is axially displaced.

Another feature of the invention resides broadly in the device for clamping flexible printing plates on the plate cylinder of rotary printing presses with an apparatus for correcting the diagonal register by swivelling the tensioning bars provided in a recess of the plate cylinder, the ends of the plate being clamped in said tensioning bars, characterized in that the tensioning bar 4 for the front edge 3 of the printing plate 2 is held in the region of a plate side edge 14 in such a manner as to be swivellable about a bolt 15 attached in the recess 13 of the plate cylinder 1, in that, on the opposite side, an eccentric bolt 18 is rotatably held in the tensioning bar 4, the eccentric pin 21 of said eccentric bolt 18 being guided in an oblong hole 22 in the base of the recess 13, in that the tensioning bar 8 for the rear edge 7 of the printing plate 2 is axially displaceably held on the tensioning bar 4 for the front edge 3 and in that, for the axial displacement of the tensioning bar 8 for the rear edge 7 of the printing plate 2, a plunger 36 penetrates, in the region of the eccentric bolt 18, the tensioning bar 4' for the front edge 3, the plunger 36 being supported under the force of a spring 37 on a side wall of the recess 13 and being at its opposite end a bevelled section 39, the bevelled section 39 engaging a bevelled cut-out 40 in the tensioning bar 8' for the rear edge 7, with the result that, when the tensioning bar 4' for the front edge 3 is swivelled, the tensioning bar 8' for the rear edge 7 is axially displaced.

Still another feature of the invention resides broadly in the device, characterized in that the eccentric bolt 18 for diagonal positioning of the printing plate 2 is provided on the operating side of the printing press.

Yet still another feature of the invention resides broadly in the device, characterized in that the tensioning bar 4, 4' for the front edge 3 is swivellably pressed onto the base of the recess 13 by means of through-bolts 16 with cup springs 17 and in that the tensioning bar 8, 8' for the rear edge 7 is associates with a compression spring 41 acting in the axial direction.

As discussed previously, clamping arrangements for clamping and tensioning printing plates on plate cylinders are generally well known. As examples for various clamping and tensioning arrangements which could possibly be configured in accordance with the present invention are disclosed by the following U.S. patents, all of which are assigned to Heidelberger Drückmaschinen Aktiengesellschaft, the assignee for the present invention: U.S Pat. No. 4,831,931 to Jeschke and Stadler, entitled "Device for Tensioning a Flexible Printing Plate on a Plate Cylinder of a Rotary Printing Machine"; U.S. Pat. No. 5,014,619 to Jeschke, entitled "Device for Tensioning a Flexible Printing Plate on a Plate Cylinder of a Rotary Printing Machine"; and U.S. Pat. No. 5,088,409 to Roskosch entitled "Device for Adjusting a Flexible Printing Plate on a Plate Cylinder of a Rotary Printing Press".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 04 328, filed on Feb. 13, 1993, having inventor Willi Becker, and DE-OS P 43 04 328 and DE-PS P 43 04 328, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

List of reference characters

| | |
|---|---|
| 1 | Plate cylinder |
| 2 | Printing plate |
| 3 | Front edge |
| 4 | Tensioning bar |
| 5 | Clamping bar |
| 6 | Fitted bolt |
| 7 | Rear edge |
| 8 | Tensioning bar |
| 9 | Clamping bar |
| 10 | Pin |
| 11 | Pedestal bearing |
| 12 | Screws |
| 13 | Recess |
| 14 | Plate side edge |
| 15 | Bolt |
| 16 | Through-bolt |
| 17 | Cup spring |
| 18 | Eccentric bolt |
| 19 | Hexagonal section |
| 20 | Scale ring |
| 21 | Pin |
| 22 | Oblong hole |
| 23 | Base plate |
| 24 | Screws |
| 25 | Slot |
| 26 | Roller |
| 27 | Lever arm |
| 28 | Angle lever |
| 29 | Swivel pin |
| 30 | Cut-out |
| 31 | Lever arm |
| 32 | Opening |
| 33 | Pin |
| 34a, 34b | Direction arrows |
| 35a, 35b | Direction arrows |
| 36 | Plunger |
| 37 | Spring |
| 38 | End-piece |

-continued

| List of reference characters | |
|---|---|
| 39 | Bevelled section |
| 40 | Cut-out |
| 41 | Compression spring |

What is claimed is:

1. In combination a plate cylinder for a rotary printing press and a device for clamping a flexible printing plate on the plate cylinder and for correcting diagonal register of the printing plate on the plate cylinder, the printing plate having first and second ends, the plate cylinder having a recess therein for accomodating the device, the recess having a base with first and second side portions disposed in a spaced apart relationship with one another, said device comprising:

first clamp means for being disposed within the recess to clamp the first end of the printing plate to the plate cylinder, said first clamp means having a first end and a second end;

second clamp means for being disposed within the recess to clamp the second end of the printing plate to the plate cylinder;

means for mounting said first clamp means in the recess of the plate cylinder, said means for mounting comprising a pivot disposed adjacent the first end of said first clamp means, said second end of said first clamp means being pivotable about said pivot;

means for pivoting said second end of said first clamp means with respect to said pivot, said means for pivoting comprising bolt means defining a longitudinal axis and being disposed radially through said first clamp means;

said bolt means having a first end for being disposed in a slot within the recess, said first end comprising pin means, said pin means defining a longitudinal axis, said longitudinal axis of said pin means being parallel to and eccentric with respect to said longitudinal axis of said bolt means; and said bolt means being configured to rotate within said first clamp means eccentrically about said pin means to pivot said first clamp means within the recess of the plate cylinder;

means for connecting said second clamp means to said first clamp means, said second clamp means being axially displaceable within said means for connecting; and lever means configured for axially displacing said second clamp means during pivoting of said first clamp means, said lever means comprising:

a pivot fixedly mounted on said first clamp means adjacent said second clamp means;

a first lever arm, said first lever arm having a first end at said pivot and extending in a direction towards said second end of said first clamp means to a second end;

a second lever arm, said second lever arm having a first end at said pivot and extending to a second end at said second clamp means;

said second clamp means comprising a means for engaging said second end of said second lever arm therein;

the plate cylinder having, within the recess thereof, means for engaging said second end of said first lever arm; and said second end of said second lever arm is configured to move axially towards and away from said first end of said first clamp means during pivoting of said first clamp means towards and away from the first side of the recess of the plate cylinder to axially displace said second clamp means.

2. The device according to claim 1, wherein:

the plate cylinder is for being disposed in a printing press, the printing press having a first side and a second side disposed in a spaced apart relationship with one another;

the first side of the printing press comprising an access side of the printing press for allowing operator access; and said bolt means of said means for pivoting is for being disposed towards the first side of the printing press when the plate cylinder with said clamping device disposed therein is installed in the printing press.

3. The device according to claim 2, wherein:

said means for mounting said first clamp means in the recess further comprises additional bolt means for fastening said first clamp means into the recess of the plate cylinder, said additional bolt means being disposed radially through said first clamp means and said bolt means comprising cup spring elements for pressing said first clamp means into engagement with the base of the recess; and said plate cylinder further comprises an additional spring element for biasing said second clamp means in the axial direction of said second clamp means to provide play-free positioning of said second clamp means within the plate cylinder.

4. The device according to claim 3, wherein:

said first and second clamp means comprise tension bars for tensioning the printing plate about the plate cylinder;

said second end of said first arm of said lever means comprises a forked end;

said means for engaging said second end of said second arm of said lever means comprises a pin disposed in the recess of said plate cylinder;

said second end of said second arm of said lever means comprises roller means mounted thereon; and said means for engaging of said second clamp means comprises slot means in said second clamp means, said roller means being disposed within said slot means of said second clamp means for moving said second clamp means axially upon pivoting of said first clamp means.

5. The device according to claim 4, wherein:

said means for connecting said second clamp means to said first clamp means comprise bracket means disposed at each of said first and second ends of said first clamp means;

each of said bracket means being bolted to said first clamp means, and each of said bracket means comprising an orifice therein disposed in alignment with the orifice of the other braket means; and said second clamp means comprises first and second members disposed at the first and second ends thereof, said first and second members being slidably disposed in said orifices of said bracket means for movement of said second clamp means axially with respect to said first clamp means;

said pivot of said first clamp means for being disposed adjacent said first side of the recess;

said bolt means of said means for pivoting comprises a second end disposed opposite said first end thereof;

said second end of said bolt means of said means for pivoting comprising:

means for engaging and turning said bolt means; and scale means for displaying an amount of said turning of said bolt means and thus an amount of said pivoting of said first clamp means within the recess;

the base of the recess of said plate cylinder comprises an additional recess therein; and said device further comprises a plate means for being disposed within the additional recess, said plate means comprising said slot means for receiving said pin means of said bolt means therein, and said plate means being configured to be movable within the additional recess for setting the position of said first clamp means within the recess.

6. In combination a plate cylinder for a rotary printing press and a device for clamping a flexible printing plate on the plate cylinder and for correcting diagonal register of the printing plate on the plate cylinder, the printing plate having first and second ends, the plate cylinder having a recess therein for accomodating the device, the recess having a base with first and second side portions disposed in a spaced apart relationship with one another, said device comprising:

first clamp means for being disposed within the recess to clamp the first end of the printing plate to the plate cylinder, said first clamp means having a first end and a second end;

second clamp means for being disposed within the recess to clamp the second end of the printing plate to the plate cylinder;

means for mounting said first clamp means in the recess of the plate cylinder, said means for mounting comprising a pivot disposed adjacent the first end of said first clamp means, said second end of said first clamp means being pivotable about said pivot;

means for pivoting said second end of said first clamp means with respect to said pivot, said means for pivoting comprising bolt means defining a longitudinal axis and said bolt means for being disposed through said first clamp means in a direction radially with respect to the plate cylinder;

said bolt means having a first end for being disposed in a slot within the recess, said first end comprising pin means, said pin means defining a longitudinal axis, said longitudinal axis of said pin means being parallel to and eccentric with respect to said longitudinal axis of said bolt means; and said bolt means being configured to rotate within said first clamp means eccentrically about said pin means to pivot said first clamp means within the recess of the plate cylinder;

means for connecting said second clamp means to said first clamp means, said second clamp means being axially displaceable within said means for connecting; and said first clamp means has a bore therein from a first side thereof to a second side thereof, said bore being disposed adjacent said second end of said first clamp means;

said first clamp means further comprises rod means disposed within the bore of said first clamp means, said rod means having:

a first end biased in a direction away from said first clamp means and configured to engage the first side of the recess of the plate cylinder to maintain said rod means in a fixed circumferential position within the recess; and a second end disposed in engagement with said second clamp means;

said second clamp means comprising a recess therein for receiving said second end of said rod means therein;

said second end of said rod means comprising a bevelled surface configured for engaging a surface of said recess of said second clamp means for axially displacing said second clamp means in an axial direction of the plate cylinder upon said first clamp means and second clamp means being pivoted within the recess.

7. The device according to claim 6, wherein:

the plate cylinder is for being disposed in a printing press, the printing press having a first side and a second side disposed in a spaced apart relationship with one another;

the first side of the printing press comprising an access side of the printing press for allowing operator access; and said bolt means of said means for pivoting is for being disposed towards the first side of the printing press when the plate cylinder with said clamping device disposed therein is installed in the printing press.

8. The device according to claim 7, wherein:

said means for mounting said first clamp means within the recess further comprises additional bolt means for fastening said first clamp means into the recess of the plate cylinder, said additional bolt means being disposed radially through said first clamp means and said additional bolt means comprising spring elements for pressing said first clamp means into engagement with the base of the recess; and the plate cylinder further comprises an additional spring element for biasing said second clamp means in the axial direction of said second clamp means to provide play-free positioning of said second clamp means within the plate cylinder.

9. The device according to claim 8, wherein:

said first and second clamp means comprise tension bars for tensioning said printing plate about the plate cylinder;

said rod means comprises a first portion having a first diameter and second portion having a second diameter, said second diameter being greater than said first diameter, and said first end comprising said second portion;

said bore of said first clamp means has a first portion for receiving said first portion of said rod means therein, said first portion of said bore having a diameter corresponding to said first diameter of said first portion of said rod means, and said bore having a second portion for receiving said second portion of said rod means therein, said second portion of said bore having a diameter corresponding to said second diameter of said second portion of said rod means;

said device further comprises a spring disposed in said second portion of said bore between said first portion of said bore and said second portion of said rod means to bias said rod means in a direction towards said first end of said rod means; and said recess of said second clamp means for engaging said bevelled end of said rod means comprises a bevelled surface for engaging said bevelled end of said rod means.

10. The device according to claim 9, wherein:

said means for connecting said second clamp means to said first clamp means comprise bracket means disposed at said first and second ends of said first clamp means;

each of said bracket means being bolted to said first clamp means, and each of said bracket means comprising an orifice therein disposed in alignment with the orifice of the other bracket means;

said second clamp means comprises first and second members disposed at the first and second ends thereof, said first and second members being slidably disposed in said orifices of said bracket means for movement of said second clamp means axially with respect to said first clamp means;

said pivot of said first clamp means for being disposed adjacent said first side of the recess;

said bolt means of said means for pivoting comprises a second end disposed opposite said first end thereof;

said second end of said bolt means of said means for pivoting comprising:

means for engaging and turning said bolt means; and scale means for displaying an amount of said turning of said bolt means and thus an amount of said pivoting of said first clamp means within the recess;

the base of the recess of said plate cylinder comprises an additional recess therein; and said device further comprising plate means for being disposed in the additional recess, said plate means comprising said slot means for receiving said pin means of said bolt means therein, and said plate means being configured to be movable within the additional recess for setting the position of said first clamp means within the recess.

11. In combination, a plate cylinder and a device for clamping a flexible printing plate on said plate cylinder and for correcting diagonal register of the printing plate, the printing plate having first and second ends, the plate cylinder having a recess therein for receiving said device, the recess having a base with first and second side portions disposed in a spaced apart relationship with one another, said device comprising:

first clamp means for being disposed within the recess to clamp the first end of the printing plate to the plate cylinder;

second clamp means for being disposed within the recess to clamp the second end of the printing plate to the plate cylinder;

said first and second clamp means each defining a longitudinal dimension, and said longitudinal dimension of each of said first and second clamp means for being disposed substantially along an axial direction of the plate cylinder;

means for connecting said first and second clamp means to form a clamping unit;

means for mounting said clamping unit in the recess of said plate cylinder;

a sole pivot within the recess;

means for pivoting, at least in a substantially circumferential direction of the plate cylinder, at least a substantial portion of said clamping unit as an integral unit about said sole pivot;

means for determining the pivoting of said integral clamping unit; and means for simultaneously axially displacing, during the pivoting of said substantial portion of said clamping unit, at least one of said first and second clamp means an axial distance corresponding to the pivoting of said substantial portion of said clamping unit.

12. The device according to claim 11, wherein said means for determining said pivoting is directly connected to said means for axially displacing to directly axially displace said at least one of said first and second clamp means during pivoting of said substantial portion of said clamping unit.

13. The device according to claim 12, wherein:

said clamping unit has a first end and a second end with first and second sides disposed between said first and second ends, said first and second sides being disposed in spaced apart relation with one another;

said first clamp means is disposed along said first side of said clamping unit and said second clamp means is disposed along said second side of said clamping unit;

said first clamp means of said clamping unit is configured to be disposed along said first side of the recess and said second clamp means of said clamping unit is configured to be disposed along said second side of the recess; and said first and second clamp means comprise first and second tensioning bars for tensioning the printing plate about the plate cylinder.

14. The device according to claim 13, wherein:

said sole pivot is disposed adjacent said first end of said clamping unit and said first side of said clamping unit; and said second end of said clamping unit is configured to pivot about said sole pivot in a direction towards and away from said first and second sides of said recess.

15. The device according to claim 14, wherein:

said second tensioning bar is axially displaceable with respect to said first tensioning bar and said clamping unit;

said means for determining and said means for axially displacing respectively comprise first and second arms of a pivoting lever;

said pivoting lever comprises a pivot fixedly mounted on said clamping unit adjacent said second tensioning bar;

said first lever arm has a first end and a second end and said first lever arm extends from said first lever arm end at said pivot of said pivoting lever to said second lever arm end in a direction towards said second end of said clamping unit;

said second lever arm has a first end and a second end and said second lever arm extends from said first lever arm end at said pivot of sadi pivoting lever to said second lever arm end at said second tensioning bar;

said second tensioning bar comprising a recess for receiving said second end of said second lever arm; and the plate cylinder comprises, within the recess thereof, means for engaging said second end of said first lever arm.

16. The device according to claim 15, wherein:

said means for engaging said second end of said first lever arm comprises means for retaining said second end of said first lever arm in a fixed circumferential position within the recess of the plate cylinder;

said second end of said second lever arm comprises roller means for being disposed in said recess of said second tensioning bar;

said second end of said second lever arm is configured to move axially towards said first end of said clamping unit during pivoting of said clamping unit towards said first side of the recess of said plate cylinder; and said second end of said second lever arm is configured to move axially away from said first end of said clamping unit during pivoting of said clamping unit away from said first side of the recess of said plate cylinder.

17. The device according to claim 16, wherein:

said means for pivoting comprises bolt means for being disposed disposed through said clamping unit adjacent said second end of said clamping unit in a radial direction of the plate cylinder;

said clamping unit has a bottom surface for being disposed towards the base of the recess of said plate cylinder and a top surface disposed opposite the bottom surface;

said bolt means defines a longitudinal axis;

said bolt means having a first end protruding from said top surface of said clamping unit and a second end protruding from said bottom surface of said clamping unit;

said first end of said bolt means comprising means for turning said bolt means within said clamping unit;

said second end of said bolt means comprising pin means for engaging a slot in the recess of said plate cylinder, said pin means defining a longitudinal axis, said longitudinal axis of said pin means being parallel to and eccentric with respect to said longitudinal axis of said bolt means; and said bolt means being configured to rotate within said clamping unit eccentrically about said pin means to pivot said clamping unit within the recess of the plate cylinder.

18. The device according to claim 17, wherein:

said plate cylinder is for being disposed in a printing press, the printing press having a first side and a second side disposed in a spaced apart relationship with one another;

said first side of the printing press comprising an access side of the printing press for allowing operator access;

said plate cylinder with said clamping device disposed therein is for being installed in the printing press with said bolt means of said means for pivoting disposed towards said first side of the printing press;

said means for mounting said clamping unit in the recess further comprises additional bolt means for fastening said first clamp means into the recess of the plate cylinder, said additional bolt means being disposed radially through said first clamp means and said additional bolt means comprising cup spring elements for pressing said first clamp means into engagement with the base of the recess;

said plate cylinder further comprises an additional spring element for biasing said second clamp means in the axial direction of said second clamp means to provide play-free positioning of said second clamp means within the plate cylinder;

said second end of said first arm of said lever means comprises a forked end;

said means for retaining said second end of said second arm of said lever means comprises a pin disposed in the recess of said plate cylinder;

said recess of said second clamp means comprises a slot means in said second clamp means, said roller means being disposed within said slot means of said second clamp means for moving said second clamp means axially upon pivoting of said first clamp means;

said means for connecting said second clamp means to said first clamp means comprise bracket means disposed at said first and second ends of said first clamp means;

each of said bracket means being bolted to said first clamp means, and each of said bracket means comprising an orifice therein disposed in alignment with the orifice of the other braket means;

said second clamp means comprises first and second members disposed at the first and second ends thereof, said first and second members being slidably disposed in said orifices of said bracket means for movement of said second clamp means axially with respect to said first clamp means;

said first end of said bolt means of said means for pivoting comprising scale means for reading an amount of said turning of said bolt means and thus an amount of said pivoting of said first clamp means within the recess;

the base of the recess of said plate cylinder comprises an additional recess therein; and said additional recess comprising an adjustable plate therein, said adjustable plate comprising said slot means for receiving said pin means of said bolt means therein, and said adjustable plate being movable for setting the position of said first clamp means within the recess.

19. The device according to claim 14, wherein:

said second tensioning bar is axially displaceable with respect to said first tensioning bar and said clamping unit;

said clamping unit has a bore therein from a first side thereof to a second side thereof, said bore being disposed adjacent said second end of said clamping unit;

said clamping unit further comprises rod means disposed within the bore of said clamping unit, said rod means having:

a first end biased in a direction away from said clamping unit and configured to engage the first side of the recess of the plate cylinder to maintain said rod means in a fixed circumferential position within the recess; and a second end disposed in engagement with said second clamp means;

said means for determining and said means for axially displacing respectively comprise said first end and said second end of said rod means;

said second clamp means comprising a recess therein for receiving said second end of said rod means therein;

said second end of said rod means comprising a bevelled surface configured for engaging a surface of said recess of said second clamp means for axially displacing said second clamp means in an axial direction of the plate cylinder upon said first clamp means and second clamp means being pivoted within the recess.

20. The device according to claim 19, wherein:

said rod means comprises a first portion having a first diameter and second portion having a second diameter, said second diameter being greater than said first diameter, and said first end comprising said second portion;

said bore of said first clamp means has a first portion for receiving said first portion of said rod means therein, said first portion of said bore having a diameter corresponding to said first diameter of said first portion of said rod means, and said bore having a second portion for receiving said second portion of said rod means therein, said second portion of said bore having a diameter corresponding to said second diameter of said second portion of said rod means;

said device further comprises spring means disposed in said second portion of said bore between said first portion of said bore and said second portion of said rod means to bias said rod means in a direction towards said first end of said rod means;

said recess of said second clamp means for engaging said bevelled end of said rod means comprises a bevelled surface for engaging said bevelled end of said rod means;

said means for pivoting comprises bolt means disposed in a radial direction through said clamping unit adjacent said second end of said clamping unit;

said clamping unit has a bottom surface for being disposed towards the base of the recess of said plate cylinder and a top surface disposed opposite the bottom surface;

said bolt means defines a longitudinal axis;

said bolt means having a first end protruding from said top surface of said clamping unit and a second end protruding from said bottom surface of said clamping unit;

said first end of said bolt means comprising means for turning said bolt means within said clamping unit;

said second end of said bolt means comprising pin means for engaging a slot in the recess of said plate cylinder, said pin means defining a longitudinal axis;

said longitudinal axis of said pin means being parallel to and eccentric with said longitudinal axis of said bolt means;

said bolt means being configured to rotate within said clamping unit eccentrically about said pin means to pivot said clamping unit within the recess of the plate cylinder;

said plate cylinder is for being disposed in a printing press, the printing press having a first side and a second side disposed in a spaced apart relationship with one another;

said first side of the printing press comprising an access side of the printing press for allowing operator access;

said plate cylinder with said clamping device disposed therein is for being installed in the printing press with said bolt means of said means for pivoting disposed towards said first side of the printing press;

said means for mounting said clamping unit in the recess further comprises additional bolt means for fastening said first clamp means into the recess of the plate cylinder, said additional bolt means being disposed radially through said first clamp means and said additional bolt means comprising cup spring elements for pressing said first clamp means into engagement with the base of the recess;

said plate cylinder further comprises an additional spring element for biasing said second clamp means in the axial direction of said second clamp means to provide play-free positioning of said second clamp means within the plate cylinder;

said means for connecting said second clamp means to said first clamp means comprise bracket means disposed at said first and second ends of said first clamp means;

each of said bracket means being bolted to said first clamp means, and each of said bracket means comprising an orifice therein disposed in alignment with the orifice of the other braket means;

said second clamp means comprises first and second members disposed at the first and second ends thereof, said first and second members being slidably disposed in said orifices of said bracket means for movement of said second clamp means axially with respect to said first clamp means;

said first end of said bolt means of said means for pivoting additionally comprises scale means for reading an amount of said turning of said bolt means and thus an amount of said pivoting of said first clamp means within the recess;

the base of the recess of said plate cylinder comprises an additional recess therein; and said additional recess comprising an adjustable plate therein, said adjustable plate comprising said slot means for receiving said pin means of said bolt means therein, and said adjustable plate being movable for setting the position of said first clamp means within the recess.

* * * * *